US005981908A

United States Patent [19]

McGuire et al.

[11] Patent Number: 5,981,908

[45] Date of Patent: Nov. 9, 1999

[54] HEATING APPARATUS FOR VERTICALLY STACKED HAIR ROLLERS

[75] Inventors: Kathleen Ruth McGuire, 515 Almer, Apt. No. 9, Burlingame, Calif. 94010; Matthew John Cullinane, Woodland Hills, Calif.

[73] Assignee: Kathleen Ruth McGuire

[21] Appl. No.: 09/028,710

[22] Filed: Feb. 24, 1998

Related U.S. Application Data

[60] Provisional application No. 60/039,456, Feb. 25, 1997.

[51] Int. Cl.[6] ..... A45D 1/04

[52] U.S. Cl. ..... 219/242; 219/222; 219/521; 132/229

[58] Field of Search ..... 219/222, 242, 219/521; 132/226, 227, 229; 221/150 A, 151, 192, 312 A, 29, 92, 124, 254

[56] References Cited

U.S. PATENT DOCUMENTS

| | | | |
|---|---|---|---|
| 3,377,943 | 4/1968 | Martin | 219/521 |
| 3,415,254 | 12/1968 | Brock et al. . | |
| 3,430,635 | 3/1969 | Kemp et al. | 132/229 |
| 3,483,876 | 12/1969 | Planel . | |
| 3,589,522 | 6/1971 | Chiodo | 219/521 |
| 3,635,146 | 1/1972 | Aubert | 219/530 |
| 3,705,974 | 12/1972 | Nilsson | 219/222 |
| 4,691,095 | 9/1987 | Barowski et al. | 219/222 |
| 5,389,763 | 2/1995 | Nagan et al. | 219/242 |
| 5,526,829 | 6/1996 | Smith . | |

FOREIGN PATENT DOCUMENTS

| | | |
|---|---|---|
| 847985 | 10/1939 | France . |

*Primary Examiner*—John A. Jeffery
*Attorney, Agent, or Firm*—Ali Kamarei

[57] ABSTRACT

A hair roller heating apparatus for heating hair rollers, has a base and a plurality of heating rods of sufficient length to simultaneously hold and heat a plurality of hair rollers. The heating rods further have a distal portion and a proximal portion, the proximal portion attached to the base and the distal portion free for receiving hair rollers. The heating rods also have an outer casing and heating elements placed within the outer casing. An electrical cord provides electricity from an electrical source to the heating elements, Therefore, the heating rods impart sufficient heat to the hair rollers to heat the rollers to a desired temperature. In a preferred embodiment the heating rods are at least 10 inches in length.

14 Claims, 3 Drawing Sheets

HEATING APPARATUS FOR VERTICALLY STACKED HAIR ROLLERS

TECHNICAL FIELD

The present application is a continuation-in-part of United States provisional application number 60/039,456 filed on Feb. 25, 1997, and relates to an apparatus invention for heating hair rollers used for hair styling. In particular, the present invention relates to a hot roller apparatus having a heating element that accepts a plurality of hair rollers.

BACKGROUND

The use of hair rollers for hair styling is well known. There are many commercially available hair roller heater roller sets for home use. Currently, heating apparatuses for heating hair rollers include a plurality of heating rods with each heating rod capable of heating only one hair roller. Consequently, in order to accommodate many rollers, the overall dimension of the apparatus is quite large and takes much needed counter space during use, as well as storage space during periods of non-use. Additionally, because of space restraints and in order to hold as many hair rollers as possible, the available hair roller heaters are designed for hair rollers that have an outer diameter of less than 2 inches. Consequently, hot hair rollers are available only for those who wish to curl their hair. Those individuals who wish to straighten their hair, which is accomplished by hair rollers that are more than 2 inches in diameter, have to do so using other means. Clearly, a compact apparatus for heating hair rollers is desirable. Further, it is desirable to have a hair roller heating apparatus for heating hair rollers with an outer diameter of at least 2 inches.

SUMMARY

The invention is described in relation to a hair roller heating apparatus for heating hair rollers. The heating apparatus has a base; a heating rod of sufficient length to simultaneously hold and heat a plurality of hair rollers. The heating rod further comprises a distal portion and a proximal portion, the proximal portion attached to the base and the distal portion free for receiving hair rollers; an outer casing; and heating elements placed within the outer casing. An electrical cord provides electricity from an electrical source to the heating elements, Therefore, the heating rods impart sufficient heat to the hair rollers to heat the rollers to a desired temperature. In one embodiment the heating rod is at least 5 inches in length. In one embodiment the heating rod is at least 7 inches in length. In a preferred embodiment the heating rod is at least 10 inches in length. In yet another embodiment, the heating apparatus ejector for pushing the hair rollers from the base towards the distal portion of the heating rod. In another embodiment a plurality of heating rods with the indicated description is employed.

DETAILED DESCRIPTION

Figure 1A:
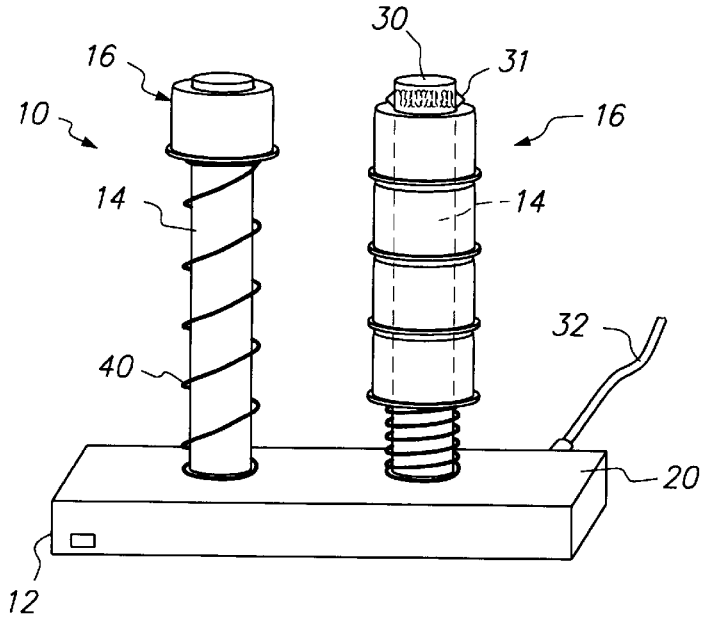
FIGS. 1*a* and 1*b* show the apparatus of the invention for heating hair rollers and an example of a hair roller.
Figure 1B:
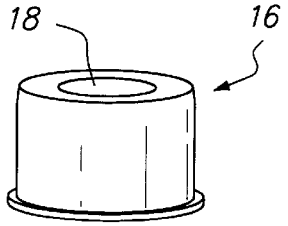

FIG. 1 shows the vertically stacked hair roller heating apparatus 10 having a base 12, one or more heating rods 14, each heating rod 14 accommodating and supporting a plurality of hair rollers 16. The base 12 houses an electrical system (not shown) and an on/off mechanism, such as those found in commercially available hot hair roller systems, for providing electrical power to heating rods 14. The base 12 also supports the cylinder shaped heating rods 14, such that the axis of the cylinder shaped heating rods 14 is perpendicular to the plane of the surface of base 12.

In a preferred embodiment, each hair roller 16 is manufactured from $1/16^{th}$ inches silicon bonded neoprene, and having a central opening 18 with a diameter large enough to accommodate the outer diameter of heating rod 14. The diameter of heating rod 14 is at least 1 inches and more preferably 1.25 inches. The diameter of central opening 18 is preferably slightly larger so that the hair rollers have enough surface contact with heating rods 14 so that the hair roller can be heated to a desired temperature.

Base 12 is formed from any suitable material such as metal or plastic. Heating rods 14 are at least approximately between 5 inches in length. Preferably, heating rods 14 are at least 7 inches in length. In a most preferred embodiment, heating rods 14 are preferably at least 10 inches in length. The base 12 supports the first hair roller that is placed for heating. Thereafter, it is understood that a plurality of hair rollers 16 are stacked vertically on top of each other when the distal end 30 of heating rods 14 is passed through central opening 18 of the hair rollers.

Figure 2:
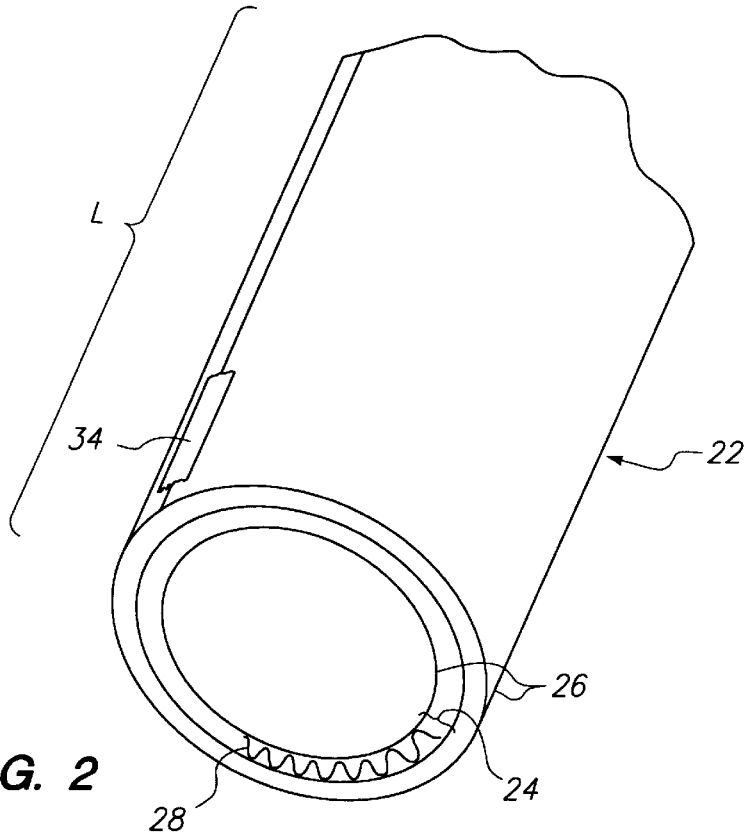
FIG. 2 shows the cross section of a heating rod having heating elements, for accommodating and supporting a plurality of hair rollers.
Figure 3:
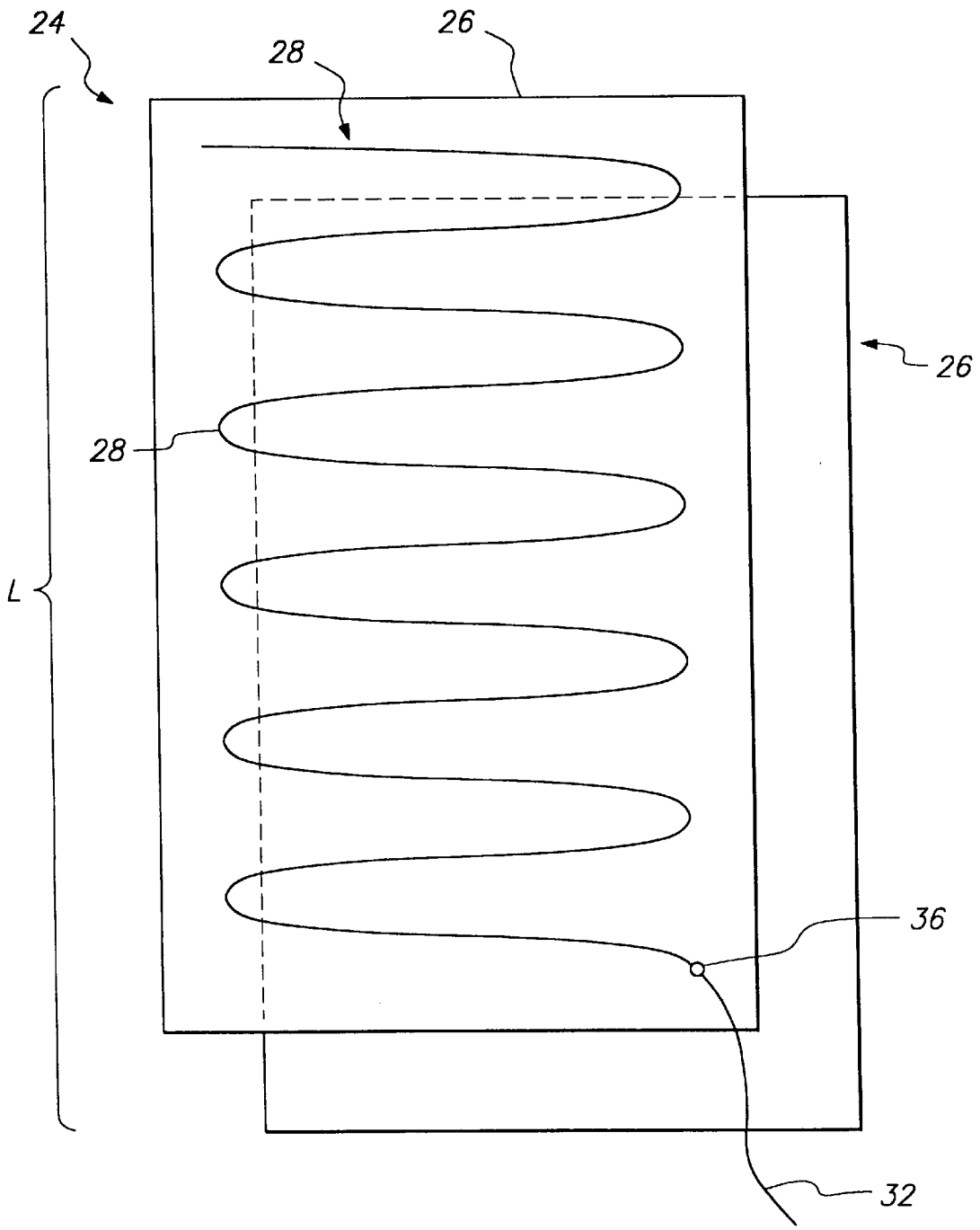
FIG. 3 shows a preferred method for manufacturing a heating rod.

Turning now to FIG. 2, heating rods 14, comprise an outer casing 22 preferably of aluminum or other equivalent heat conductive material, the outer casing 22 being heated from the inside by heating element 24. In a preferred embodiment, heating element 24 comprises two sheets of fiberglass material 26 (commercially available as silicon bonded MICA paper) with the two fiberglass sheets 26 sandwiching heating wires 28, as shown in FIG. 3. Heating wires 28 are preferably Nichrome wires or other commercially available heating wires. This type of Nichrome wire structure may be found in currently available curling irons. A temperature controller included in the Nichrome wire structure, which is well known in the art, keeps the heating element between 250 and 350° F. Heating element 24 is adapted to be connected to electrical chord 32 for providing electrical power necessary to heat the heating element 24. The electrical chord is plugged into a conventional wall outlet. The outer casing 22 is preferably supported by base 12, either at the surface of the base 20 or from inside of the base.

Figure 4:
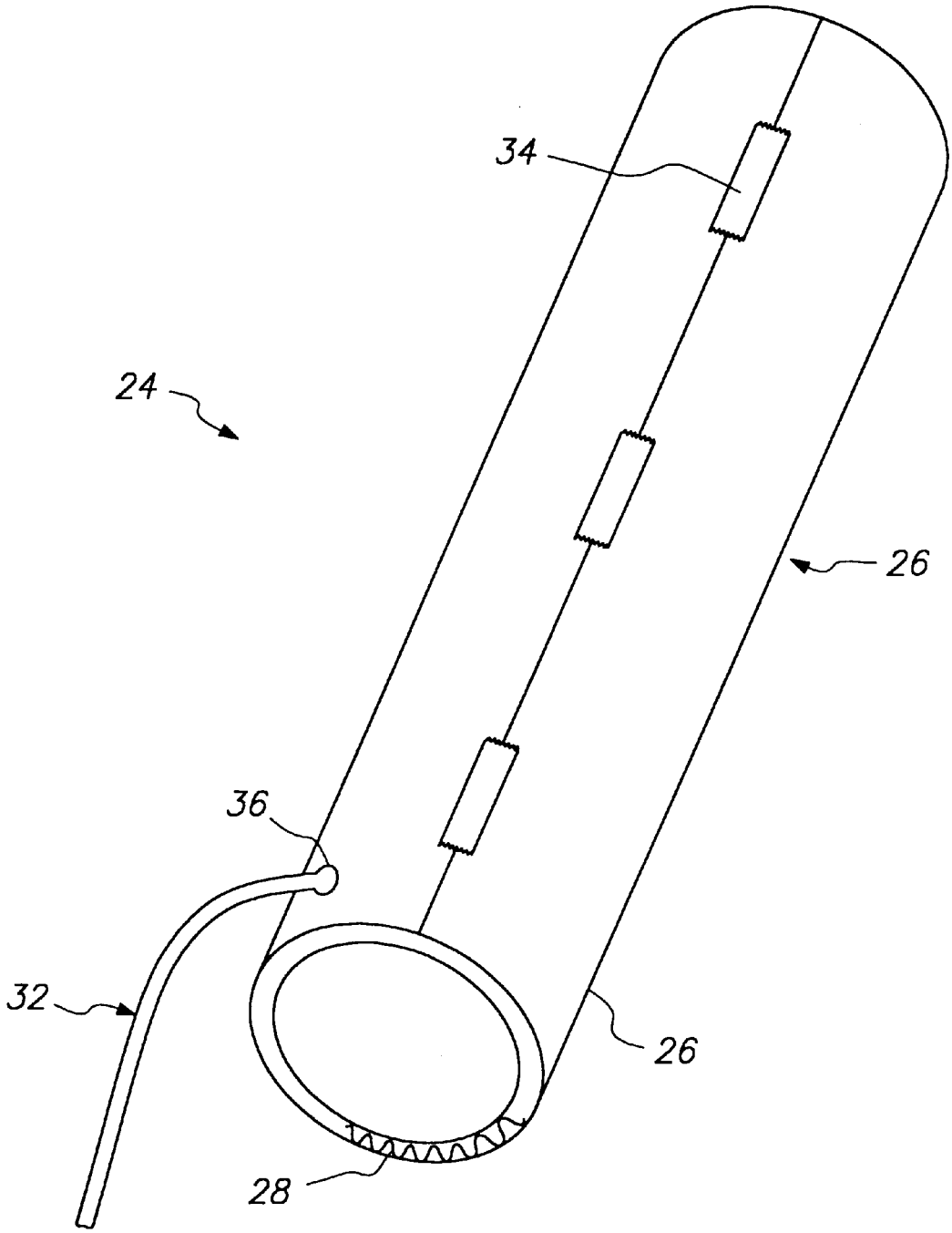
FIG. 4 shows the connection of heating elements of the heating rod with the power cord.

FIG. 4. shows the assembly of heating element 24. Heating element 24 is formed by curling the fiberglass sheets 26 into a rod shaped cylinder by attaching the edges of the fiberglass sheets 26 to each other using attachment means 34. Attachment means 34 is preferably of material that does not loose its adhesive capability when experiencing high temperatures. A suitable material is Kapton tape which is commercially available in the industry. An eyelet 36 facilitates the connection between power cord 32 and heating wires 28.

Conventional hair rollers may be used with the present invention, however, larger hair rollers having the following dimensions may also be used with the heating apparatus of the present invention. These larger hair rollers may be 3 inches high with an outer diameter of 3 inches and an inner diameter of 2¾ inches In an alternative embodiment, the rollers may be 3 inches tall with an outer diameter of 2½ inches and an inner diameter of 2¼ inches.

In a preferred embodiment, insulative covers (not shown) cover each of the heating rods 14. The insulative cover is formed from a heat tempered plastic casing preferably, a polycarbonate tubing, and is of dimensions and shape so that heating rods 14, can be inserted into the insulative covers. The insulative covers are used to reduce the amount of heat imparted by heating rods 14.

In another embodiment, a roller ejector 40 is employed to push up hair rollers 16 from the base 12 towards the distal end 30 of heating rods 14. The roller ejector 40 comprises a coil or spring. Ejector 40 has a diameter such that it may be located around heating rods 14 and attached to base 12. In order to prevent the ejector 40 from inadvertently pushing hair rollers off from the heating rods 14, a common latch or locking mechanism 31 is employed at the distal end 30 of heating rod 14.

In another embodiment, in addition to the base, the heating apparatus has a back support and a top flange supported by the back support. Heating rods project vertically from the top flange towards the base. Hair rollers are stacked onto the heating rod much the same way as described in the previous embodiments, however, a locking mechanism at the free end of the heating rods prevent the hair rollers from falling towards the base due to gravity.

It is now apparent that the apparatus of the present invention meets long-standing needs, and although the invention has been described with respect to preferred embodiments, it will be apparent that various changes and modifications may be made without departing from the invention as set forth in the accompanying claims.

We claim:

1. A hair roller heating apparatus for heating hair rollers, comprising;

a. a base for supporting a heating rod;

b. a heating rod of sufficient length to simultaneously hold and heat a plurality of hair rollers, further comprising;
   i. a distal portion and a proximal portion, the distal portion free for receiving hair rollers;
   ii. an outer casing;
   iii. heating elements placed within the outer casing;

c. an electrical cord for providing electricity from an electrical source to the heating elements;

d. a hair roller ejector for pushing the hair rollers from the proximal portion of the heating rod towards the distal portion of the heating rod; and e. a lock mechanism placed at the distal portion of the heating rod to prevent the inadvertent pushing of the hair rollers from the distal portion of the heating rod; the heating rods imparting sufficient heat to the hair rollers to heat the rollers to a desired temperature.

2. The apparatus of claim 1 wherein the heating rod is at least 5 inches in length.

3. The apparatus of claim 1 wherein the heating rod is at least 7 inches in length.

4. The apparatus of claim 1 wherein the heating rod is preferably 10 inches in length.

5. The apparatus of claim 1 wherein the heating rod has a diameter of at least 1 inch.

6. The apparatus of claim 1 wherein the hair rollers are stacked vertically on top of each other, the first hair roller inserted onto the heating rod being supported by the base, and each hair roller thereafter supported by another hair roller.

7. The apparatus of claim 1 further comprising an ejector for pushing the hair rollers from the base towards the distal portion of the heating rod.

8. A hair roller heating apparatus for heating hair rollers, comprising;

a. a base for supporting a heating rod;

b. a plurality of heating rods, each heating rod of sufficient length to simultaneously hold and heat a plurality of hair rollers, each heating rod further comprising;
   i. a distal portion and a proximal portion, the distal portion free for receiving hair rollers;
   ii. an outer casing;
   iii. heating elements placed within the outer casing;

c. an electrical cord for providing electricity from an electrical source to the heating elements;

d. a hair roller ejector for pushing the hair rollers from the proximal portion of the heating rod towards the distal portion of the heating rod, and e. a lock mechanism placed at the distal portion of the heating rod to prevent the inadvertent pushing of the hair rollers from the distal portion of the heating rod; the heating rods imparting sufficient heat to the hair rollers to heat the rollers to a desired temperature.

9. The apparatus of claim 8 wherein the heating rods are at least 5 inches in length.

10. The apparatus of claim 8 wherein the heating rods are at least 7 inches in length.

11. The apparatus of claim 8 wherein the heating rods are preferably 10 inches in length.

12. The apparatus of claim 8 wherein the heating rods have a diameter of at least 1 inch.

13. The apparatus of claim 8 wherein the hair rollers are stacked vertically on top of each other, the first hair roller inserted onto the heating rods being supported by the base, and each hair roller thereafter supported by another hair roller.

14. The apparatus of claim 8, wherein each heating rod further comprises an ejector for pushing hair rollers from the base towards the distal portion of the heating rod.

* * * * *